US005908459A

United States Patent [19]

Röwer et al.

[11] Patent Number: 5,908,459

[45] Date of Patent: Jun. 1, 1999

[54] ROAD FINISHER HAVING A PLURALITY OF CONTROL SYSTEMS WITH INTERCHANGEABLE CONTROL PROCESSORS

[75] Inventors: Maik Röwer, Obernkirchen; Werner Engeln; Thomas Lossow, both of Hameln, all of Germany

[73] Assignee: ABG Allgemeine Baumaschinen-Gesellschaft mbH, Hameln, Germany

[21] Appl. No.: 08/799,814

[22] Filed: Feb. 13, 1997

[30] Foreign Application Priority Data

Feb. 17, 1996 [DE] Germany ..... 196 05 926

[51] Int. Cl.[6] ..... G06G 7/76; E01C 23/07

[52] U.S. Cl. ..... 701/50; 404/84.1

[58] Field of Search ..... 171/9; 172/2, 815, 172/829, 4.5; 280/840; 73/105, 146; 404/84.1, 84.2–84.5, 84.8, 84.05, 92, 102, 108, 111, 114, 133.2, 133.05, 118; 701/50

[56] References Cited

U.S. PATENT DOCUMENTS

| | | | |
|---|---|---|---|
| 4,933,853 | 6/1990 | Musil et al. | 701/50 |
| 5,201,604 | 4/1993 | Ferguson et al. | 404/110 |
| 5,356,238 | 10/1994 | Musil et al. | 404/84.1 |
| 5,401,115 | 3/1995 | Musil et al. | 404/72 |
| 5,484,227 | 1/1996 | Ikeda et al. | 404/84.1 |
| 5,735,634 | 4/1998 | Ulrich et al. | 404/102 |

FOREIGN PATENT DOCUMENTS

| | | |
|---|---|---|
| 4141592 | 6/1993 | Germany . |
| 41 41 592 A1 | 7/1993 | Germany . |
| 93 01 031 U1 | 7/1994 | Germany . |

*Primary Examiner*—Jacques H. Louis-Jacques
*Attorney, Agent, or Firm*—John J. Selko

[57] ABSTRACT

The invention relates to a road finisher having traveling gear and a series of units which are used for the consolidation of warm packing material, the finisher having a plurality of control circuits for controlling various functions performed by the machine. Each control circuit includes a replaceable control processor therein, each control processor being adapted to replace any and all other control processors and to perform any and all control functions of any and all other control processors, whereby, when a control processor fails in service, another control processor, which is controlling a less important function, can be substituted therefor to permit continued operation.

11 Claims, 4 Drawing Sheets

ROAD FINISHER HAVING A PLURALITY OF CONTROL SYSTEMS WITH INTERCHANGEABLE CONTROL PROCESSORS

BACKGROUND OF THE INVENTION

This invention relates generally to road finishers and more particularly to road finishers having a plurality of automatic control systems thereon for controlling various functions to be performed by the machine.

The invention further relates to a road finisher having traveling gear and a series of units which are used for the consolidation of preferably warm packing material, a control panel being provided with control elements via which desired values relating to the travel and/or the individual units of the road finisher can be entered in corresponding open-loop or closed-loop control circuits which are each provided for a specific open-loop or closed-loop control task, the open-loop and closed-loop control circuits each communicating with associated sensors or actuators.

Such a road finisher is known from DE 41 41 592 A1, in accordance with which document a control console is arranged on the road finisher and can be connected to electronic control circuits for different functions, such as straight-ahead travel, constant advancing speed or cornering with adjustable speed. In this context, the control circuits are matched to the individual function, so that, in the event of a failure, appropriate spare parts must be available for replacement purposes. Apart from this, replacement is necessary. In particular if warm packing material (asphalt mixtures) is used, problems may arise especially as a result of cooling and hardening of the packing material in the area of the road finisher if the replacement takes too long, in particular if appropriate spare parts first have to be obtained.

The foregoing and other aspects will become apparent from the following detailed description of the invention when considered in conjunction with the accompanying drawing figures.

The object of the invention is to provide a road finisher of the type mentioned at the beginning, with which faults in open-loop and/or closed-loop control circuits can be eliminated easily and quickly.

SUMMARY OF THE INVENTION

In one aspect of the present invention, this is accomplished by providing a road finisher having a chassis carrying foldable sidewalls on a front bucket, a feeding device for carrying packing material rearwardly to a screw spreading device that distributes the packing material to a consolidation plank device for spreading, the improvement comprising: the chassis including two or more control means selected from the group of control means consisting essentially of: (i) first means for controlling movement of the chassis; (ii) second means for controlling the sidewalls; (iii) third means for controlling the feed device; (iv) fourth means for controlling the screw device; (v) fifth means for controlling the consolidation plank; each of the control means including a removable control processor that is adapted to be physically interchangeable with any and all other such control processors, each of the removable control processors being adapted to control any and all functions controlled by any and all of such removable control processors.

This object is achieved in that each open-loop or closed-loop control circuit comprises a processing unit which is connected to the associated sensors or actuators and to a common bus system which is used for communication with the control panel, it being possible to exchange all the processing units in the same way and with one another, and the processing units being provided with a device for detecting the specific open-loop or closed-loop control task and for activating the open-loop or closed-loop control task with control circuit elements and/or software which are specific thereto.

By virtue of the fact that identical replaceable processing units are used between the sensor/actuator units and a display of a control panel which, alone or in conjunction with a central processing unit, perform respective open-loop and/or closed-loop control tasks, the processing units each being provided with a device for detecting the specific open-loop or closed-loop control task and for activating the circuit elements and/or software blocks of the open-loop or closed-loop control task which are specific thereto, if a replacement is not available a function which is unimportant at a given time may, if necessary, be dispensed with, so that the said processing unit can perform a function which is important at the given time, enabling the consolidation of the packing material to be continued or at least the road finisher to be emptied completely, but functions which are unimportant at a given time, such as reversing or else the vibration of the consolidation plank, for example, may be deactivated since the processing units can be used specifically at any desired location. Since the complete emptying of the bucket and of the feed track is the most important function overall, this function is designed in such a way that it can be carried out even if there is a total failure of the electronics, for example by directly activating the actuator.

BRIEF DESCRIPTION OF THE DRAWING FIGURES

The invention is explained in more detail below with reference to exemplary embodiments illustrated in the appended figures.

DETAILED DESCRIPTION

Figure 1:
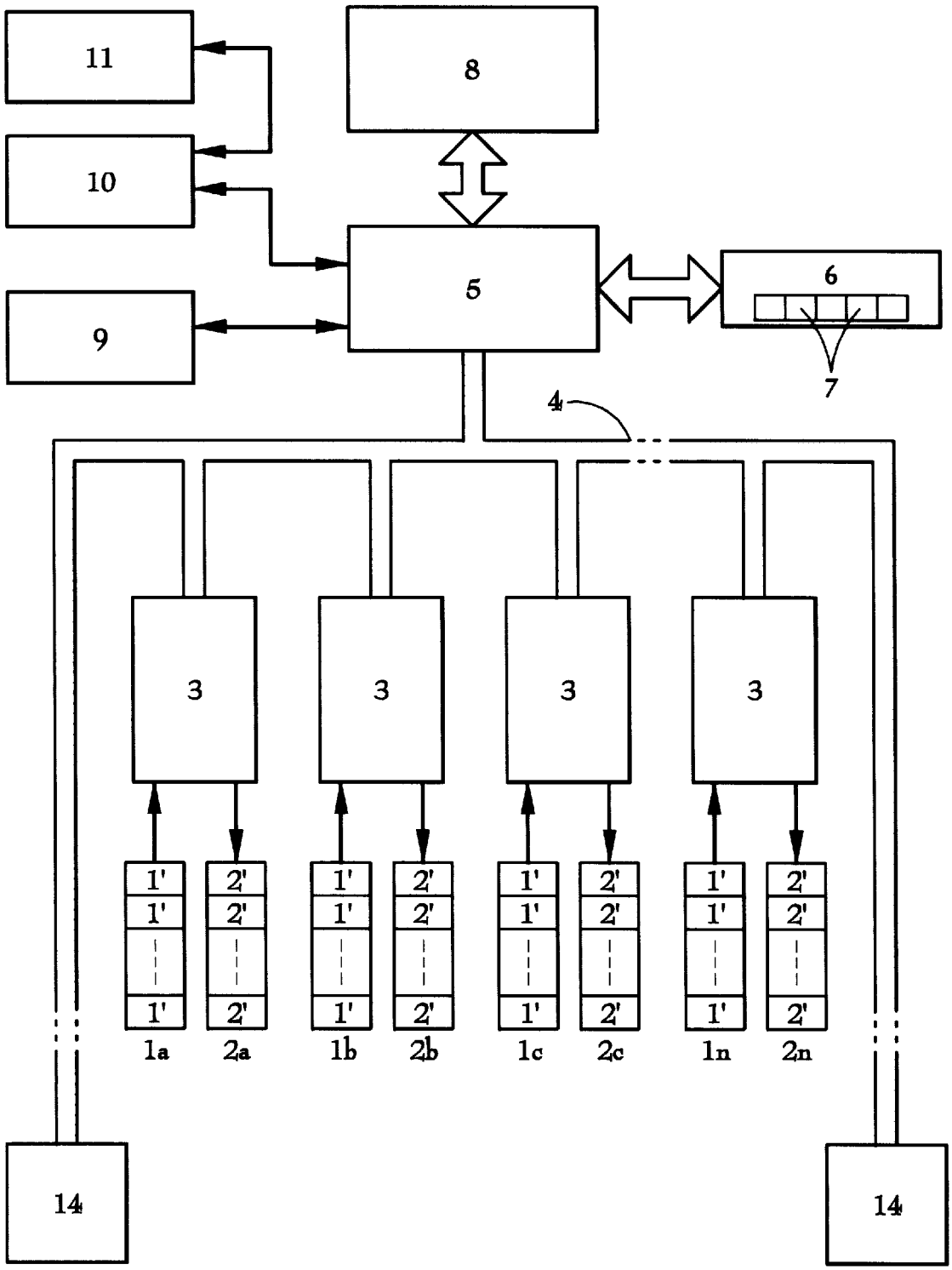
FIG. 1 shows a schematic view of an embodiment of an open-loop or closed-loop electronic controller of a road finisher.

FIG. 1 shows an embodiment in which sensor groups 1*a* to 1*n* and actuator groups 2*a* to 2*n* are provided. Each sensor group 1*a* to 1*n* comprises at least one sensor 1' and each actuator group 2*a* to 2*n* comprises at least one actuator 2'. The respective pair comprising sensor group 1x/actuator group 2*x* is part of a specific control circuit of a number thereof.

The respective pair here is part of an associated processing unit 3. All the processing units 3 are connected to a common bus system 4 in order to communicate with a control panel 6 via a central processing unit 5, which in this embodiment also comprises a bus driver. The control panel 6 constitutes the interface between man and road finisher and is expediently constructed as a display with control elements 7 constructed as sensing elements, alongside further control elements, as per FIG. 4.

The processing units 3 are constructed so that they can all be exchanged in the same way and with one another. In accordance with their arrangement in a specific control circuit, specific circuit elements and/or specific software blocks are activated for this in accordance with the closed-loop control task of this control circuit. The processing units 3 have relevant detection devices for this.

In particular, the processing devices 3 are constructed in the form of plug-in planks with electronics arranged thereon, which planks are held by appropriate plug-in locations which do not necessarily have to be arranged centrally, on the road finisher. In this context, the plug-in locations are expediently encoded, the detection device of the processing unit 3 recognizing this encoding and performing a corresponding activation.

The processing units 3 serve to condition the signals received by the associated sensors 1', to process the said signals and to communicate with the computer 5 and, if appropriate, also with one another via the bus system 4, and to transmit actuation signals to the associated actuators 2'.

The processing units 3 comprise a separate arithmetic unit (for example a micro controller or microprocessor), so that they form, at the same time, the regulator for the associated control circuit.

The desired values, data relating to the controlling of the finisher and to the consolidation, for the respective control circuits can be entered via the control elements 7 and, if appropriate, also via an interface (for example diskette or remote data transmission) of the computer 5 with the outside. Communication with the processing units 3 takes place via the computer 5, and the computer 5 also stores data relating to machine states, manages them and can transmit them via a service interface 8 to a transportable storage medium such as a diskette or a paper printout or, if necessary, to a separate computer, if appropriate via a remote data transmission 9. If appropriate, navigation sensors 11 for navigating the road finisher may be connected to the computer 5 via a navigation controller 10.

For the case of open-loop control, the same applies as to closed-loop control. If, instead of a closed-loop control task, the task is an open-loop one, the processing unit 3 is also designed for this, in which case it then just activates one or more final controlling elements serving as actuators 21, in accordance with an open-loop control specification and in accordance with the detection of its detection device.

Figure 2:
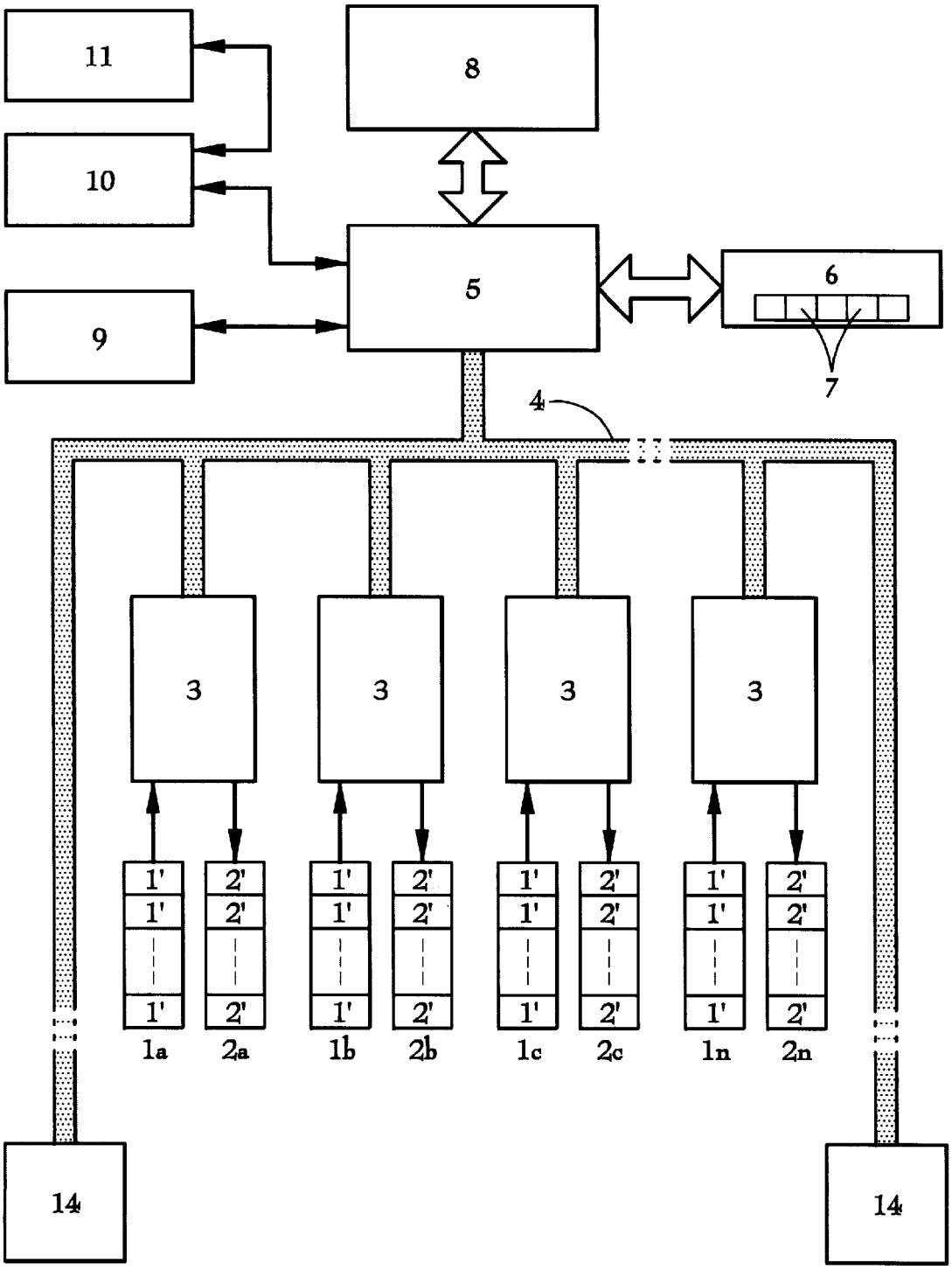
FIGS. 2 and 3 show two further embodiments of an open-loop or closed-loop electronic controller of a road finisher.

In accordance with FIG. 2, the processing units 3 do not need to be equipped with a separate computer intelligence, since the central processing unit 5 may also be used as a regulating unit. The processing units 3 then only convert the signals from sensors 1' into corresponding bus signals or convert bus signals into corresponding actuation signals for the actuators 2'. The evaluation of the sensor signals and their conversion into messages to the operator or into new actuator signals, is effected from the central processing unit 5.

However, if appropriate, the processing units 3 can also have separate arithmetic units which, however, do not have to be used in all cases. If the latter are however used, the parameters for setting the closed-loop control and the desired values are supplied by the computer 5.

Figure 3:
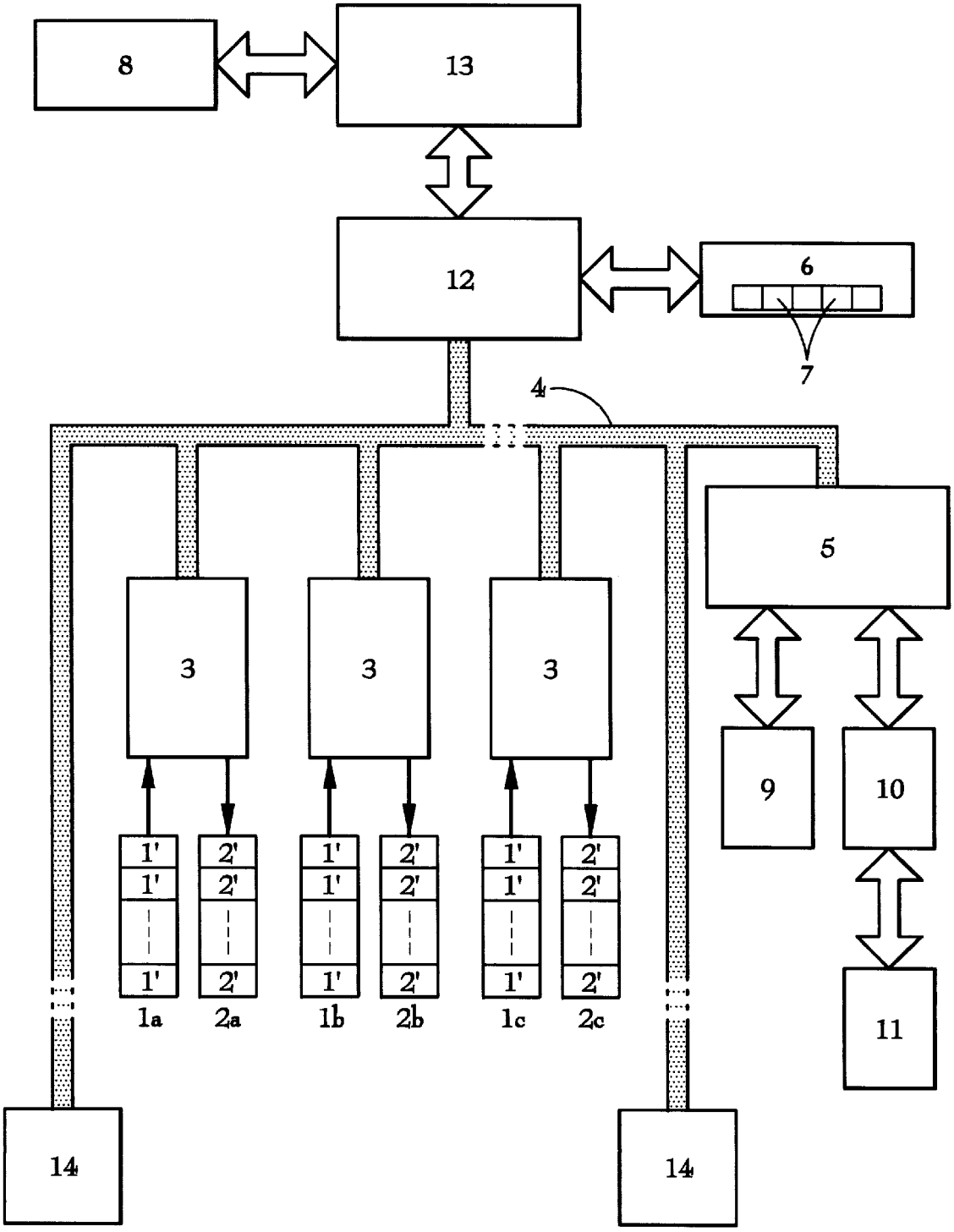

In the embodiment illustrated in FIG. 3, just one optional central processing unit 5 is present, while a separate bus driver 12, which communicates with the control panel 6 via a corresponding interface 13 (interface card with bus driver 12 for representing information on a display 14 of the control panel 6 and for interrogating the control element 7), while the processing units 3 have separate arithmetic units.

Since the processing units 3 can be exchanged with one another in all cases, when one processing unit 3 fails it can be readily exchanged without it being necessary to keep a large number of different types in stock. If no spare unit is available at a given time, a processing unit 3 can be taken from a less important location and placed in the more important location in order to fulfil closed-loop or open-loop control tasks there.

Additional processing units 3 can be used according to requirements and connected to the bus system 4.

The processing units 3 expediently comprise separate diagnostic circuits which, for the purpose of appropriate signaling of a partial failure supply signals ultimately to the user and in the case of a total failure no longer supply any message on interrogation, which is likewise indicated to the user.

Likewise, the processing unit 3 expediently checks the failure of a sensor 1' and passes this information on, so that this message reaches the operator.

The computer 5 and/or the control panel 6 do not need to be arranged at a random location on the road finisher, they may also be located in a stationary external control console which is placed anywhere, or they may be located on another road finisher, from where the road finisher is controlled. The transmission of the control data and the signaling back of information relating to the state of the road finisher and state changes to the operator may then, if appropriate, be carried out via suitable data transmission links with or without cables.

If a control element 7 on the control panel 6 fails, a corresponding message expediently appears on the display 14 and the function of the control elements 7 is changed to such an extent than a less important function is eliminated and the associated control element 7 takes over the function of the failed control element 7. In this way, it is possible for example to prevent warm packing material from cooling down and thus hardening there, owing to such a failure, in the area of the feed device arranged between the front bucket and spreader screw in the traveling gear.

Figure 4:
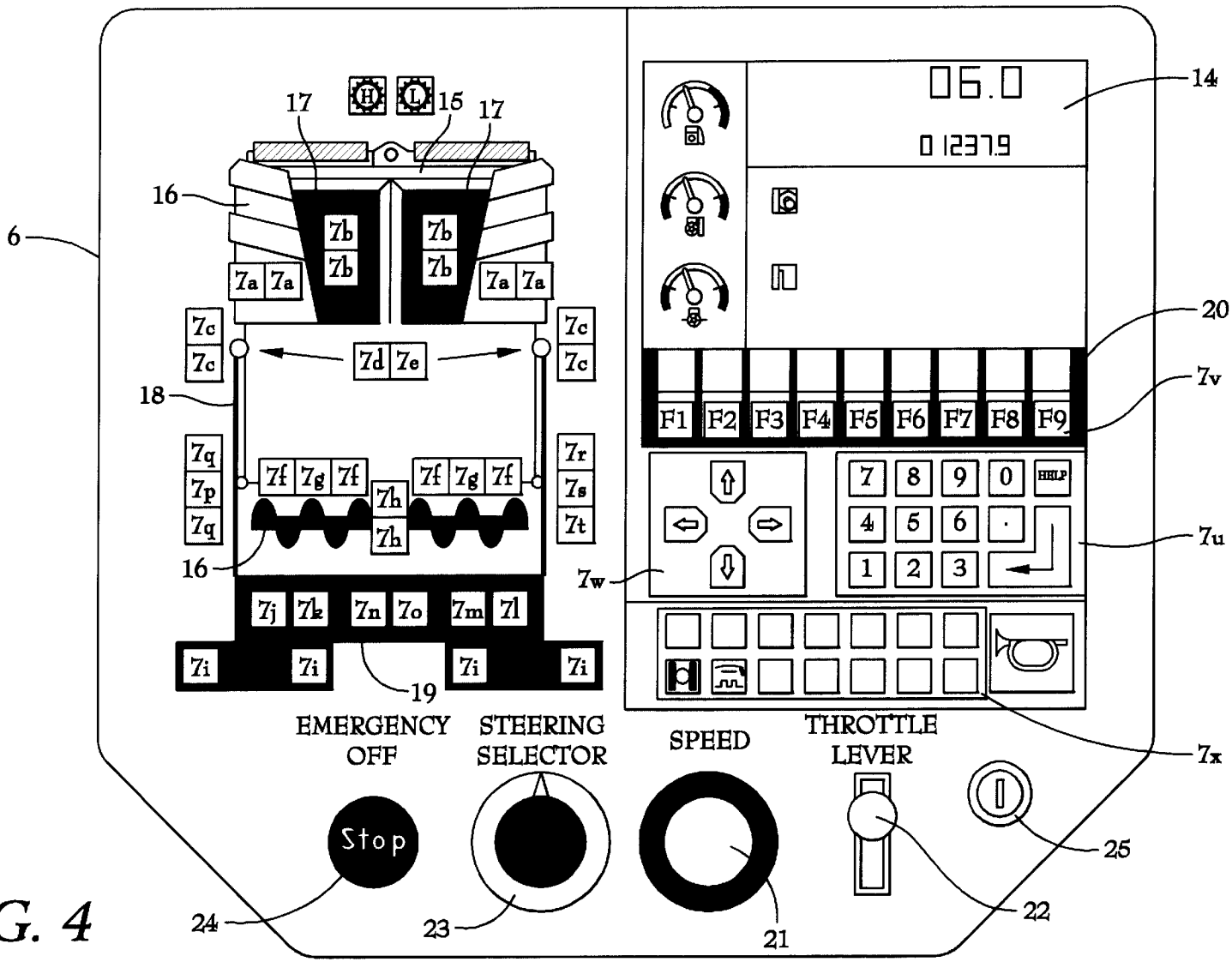
FIG. 4 shows a plan view of a control panel for an open-loop or closed-loop electronic controller for a road finisher.

In accordance with FIG. 4, one area 14*a* shows a schematic plan view of a road finisher in the form of a printed film, control elements being arranged as key buttons at appropriate locations underneath the film. The road finisher illustrated in this way comprises at the front a bucket 15 with side wall components 16 which can be folded out laterally to form a funnel and which can be activated by means of key buttons 7*a* to open or close the bucket 15, and corresponding processing units 3 which operate as control elements and to which in each case two limit position switches are assigned as sensors 1' and one actuation cylinder as actuator 2' can be adjusted. If appropriate, it is here however also possible to manage without every sensor 1', so that the processing unit 3 is coupled to just one corresponding actuator 2'.

Two feed devices 17 for the packing material to be filled into the bucket 15 extend one next to the other from the bucket 15 as far as a spreader screw 16, which feed devices 17 can be activated by means of one of the key buttons of a double key button 7*b*, it being possible to override control of their operation manually by means of that key button of the double key button 7*b* which is provided with an arrow.

Key buttons 7*c* serve to adjust the tie point of tie arms 18 for a consolidation plank 19. Key button 7*d* is used to switch on and off an automatic leveling system for the tie locations of the tie arms 18. Key button 7*e* calls up a screen menu for the automatic leveling system, in which menu parameters of the automatic leveling system can be adjusted.

The appropriate side of the spreader screw 16, which is switched on and off in automatic mode using key button 7*g*, can be overridden manually with maximum feed volume using key button 7*f* in the direction of the corresponding arrow. Using key button 7*h*, the height of the screw is adjusted on road finishers with hydraulic screw height adjustment.

Using key button 7*i*, the width of the plank is adjusted in accordance with the arrows illustrated. Using key button 7*j*, a tamper menu is called up, in which the frequency and other parameters of tampers provided on the consolidation plank 19 can be set. The tampers are switched on and off using key button 7*k*. The vibration is switched on and off using key button 71. Using key button 7*m*, a vibration menu is called up, which permits the frequency and other parameters of the vibration to be set. Using key button 7*n*, a heating menu is called up, by means of which the temperature and other parameters of the heating of the plank can be preselected. Using key button 7*o*, the plank heater can be switched on and off. Using key button 7*p*, the floating position of the consolidation plank 19 is switched on and off. Using key button 7*q*, a transport cylinder for the consolidation plank 19 is activated, in order to be able to raise the latter into the transport position, or lower it from the said position. Using key button 7*r*, a plank raising lock is switched on and off. Using key button 7*s*, a plank partial load relief device is switched on and off. Using key button 7*t*, a plank partial load relief device for when the machine is stationary is switched on and off.

Using a keypad 7*u* (ten-key keypad), parameters are input into the appropriate screen menus with "Return" and "Help". Keys 7*v* are function keys whose function is always assigned to them by means of a symbol in the relevant field 20 on the display 14. Functions are associated with the appropriate screen menu.

Arrow keys 7*w* serve to enable movement between various positions in the screen menu or to adjust values on bar displays. A keypad 7*x* contains free keys which can be provided with symbols by pushing in labels from behind. This keypad 7*x* is used to control functions which vary on different types of road finisher. Furthermore, the keys here may be assigned to special customer specific functions.

In addition, there are a potentiometer 21 for preselecting the speed of the finisher, a throttle lever 22, a steering selector 23 for preselecting the direction of travel and an emergency Off button 24 and an ignition lock 25.

Provided in the display 14 is an area where numerical values are displayed for the travel speed, operating hours, rotational speed and/or similar display instruments. If the display 14 has full graphics capability, any desired representations of graphics and outputting of alphanumeric information are possible.

External control consoles which, in a road finisher, are frequently provided on the left-hand and right-hand side of the consolidation plank 19, are expediently connected to the other processing units 3 and/or to the computer 5 via the bus system 4.

Thus, it can be understood that the following control tasks and actions are provided in a machine of the invention:

Two outwardly foldable sidewalls (16) on front bucket (15) are activated by key buttons (7*a*). Limit switches (1') and actuation cylinder 2' communicate with processing unit 3 to operate the sidewalls (16).

Two feed devices (17) extend to screws (16) and are activated by key button (7*b*).

Tie arms (18) for consolidation plank (19) are activated by key buttons (7*c*).

An automatic leveling system for tie arms (18) is activated by key buttons 7(*d*). Key button (7*e*) activates the leveling system menu, for adjusting the leveling parameters.

Spreader screws (16), one for each side, are activated by key buttons (7*g*) for automatic mode or by key button (7*f*) for manual mode.

The height of screws (16) are adjustable via key button (7*h*).

The width of consolidation plank (19) is adjustable via button (7*i*).

A tamper menu (frequency and other parameters) is called up by buttons (7*j*). Tamper on/off is set via button (7*k*). Vibration on/off is set via button (7*l*). A vibration menu on/off is set via key button (7*m*) to set vibration frequency and other parameters.

A heating menu is called up via on/off key button (7*n*). A heater is activated by on/off via key button (7*o*).

The floating position of consolidation plank 19 is activated by on/off via key button (7*p*).

The plank (19) is raised or lowered via cylinder (not shown), with on/off via key button (7*q*). Button (7*r*) locks plank (19) in position with a lock (not shown).

Plank (19) partial load relief on/off via key button (7*s*), for moving machine or (7*t*) for stationary machine.

First keypad (7*u*) inputs into various menus. Keys (7*v*) are fixed in function.

Second keypad (7*x*) inputs optional functions into menus to be chosen by operator.

A potentiometer (21) is used for preselecting speed; throttle lever (22) for speed changing; steering selector (23) for steering; and on/off switch (24) and ignition lock (25) for start-up access and control.

The computer (5) or control panel (6) can be located on the machine or in a stationary external control console off the machine (not shown) or located at either side of the machine, or at both sides thereof (FIGS. 1–4).

What is claimed:

1. In a road finisher having a chassis carrying foldable sidewalls on a front bucket, a feeding device for carrying packing material rearwardly to a screw spreading device that distributes the packing material to a consolidation plank device for spreading, the improvement comprising:

(a) said chassis including two or more control means selected from the group of control means consisting essentially of:

(i) first means for controlling movement of said chassis;

(ii) second means for controlling said sidewalls;

(iii) third means for controlling said feed device;

(iv) fourth means for controlling said screw device;

(v) fifth means for controlling said consolidation plank; and (b) each of said control means including a removable control processor physically interchangeable with any and all other such control processors, and all such control processors are connected to a common bus system in order to communicate with a control panel via a central processing unit, whereby when one of the control processors fails, another control processor with lower priority takes over the operations of the faulty processor.

2. A road finisher having traveling gear and a series of units which are used for the consolidation of preferably warm packing material, a control panel being provided with control elements via which desired values relating to the travel and/or the individual units of the road finisher can be entered in corresponding open-loop or closed-loop control circuits which are each provided for a specific open-loop or closed-loop control task, the open-loop or closed-loop control circuits each communicating with associated sensors or actuators, wherein each open-loop or closed-loop control circuit comprises a processing unit which is connected to the associated sensors or actuators and to a common bus system which is used for communication with the control panel, all the processing units being interchangeable with one another, and all the processing units being provided with a device for detecting the specific open-loop or closed-loop control task and for activating the open-loop or closed-loop control task.

3. A road finisher according to claim 2, wherein each processing unit comprises a separate arithmetic unit.

4. A road finisher according to claim 3, wherein each processing unit comprises a self-diagnostic device for checking its own operational capability with error signaling.

5. A road finisher according to claim 4, wherein each processing unit has a diagnostic device for the sensors connected thereto.

6. A road finisher according to claim 5, wherein individually encoded plug-in locations are provided for the processing units.

7. A road finisher according to claim 6, wherein the control panel comprises a display and control elements constructed as key buttons.

8. A road finisher according to claim 7, wherein the display shows a schematic plan view of the road finisher with control elements arranged therein at the locations of the units to be activated.

9. A road finisher according to claim 8, wherein the control panel comprises a diagnostic circuit which, in the event of a failure of a control element for a function with a relatively high priority, switches over the control of this function to a control element with a relatively low priority and brings about an appropriate display on the control panel.

10. A road finisher according to claim 9, wherein the control panel is arranged on the road finisher.

11. A road finisher according to claim 10, wherein the control panel, with the computer, is arranged on an external control console.

* * * * *